United States Patent [19]

Siegel

[11] 4,231,193

[45] Nov. 4, 1980

[54] VERTICAL BELT SANDING APPARATUS

[76] Inventor: John R. Siegel, 4444 Burnley Dr., Bloomfield Township, Oakland County, Mich. 48013

[21] Appl. No.: 972,476

[22] Filed: Dec. 22, 1978

[51] Int. Cl.[3] ..... B24B 21/00

[52] U.S. Cl. ..... 51/141; 51/148

[58] Field of Search ..... 51/135 R, 135 BT, 141, 51/148; 74/242.8, 242.9, 242.11 A, 242.11 C, 242.15 R

[56] References Cited

U.S. PATENT DOCUMENTS

| | | | |
|---|---|---|---|
| 2,452,205 | 10/1948 | Newton | 51/135 R |
| 2,565,223 | 8/1951 | Gentzel | 51/148 |
| 2,624,160 | 1/1953 | Harper | 51/141 |
| 2,742,741 | 4/1956 | Frostad | 51/148 X |
| 2,791,070 | 5/1957 | Schaller | 51/148 X |
| 3,134,206 | 5/1964 | Olton et al. | 51/148 X |
| 3,170,272 | 2/1965 | Burnham | 51/141 |
| 3,176,436 | 4/1965 | Anton | 5/148 X |
| 3,436,979 | 4/1969 | Molitor | 74/242.15 R |
| 3,465,479 | 9/1969 | Foody et al. | 51/148 |
| 3,664,208 | 5/1972 | Saito | 51/135 R X |
| 4,115,957 | 9/1978 | Porth | 51/148 X |

*Primary Examiner*—Gary L. Smith
*Assistant Examiner*—Robert P. Olszewski
*Attorney, Agent, or Firm*—Irving M. Weiner; John L. Shortley; Melvin Yedlin

[57] ABSTRACT

A belt sanding apparatus adapted for use in forming patterns of expanded synthetic-resinous materials is provided with a vacuum platen to prevent flutter of a sanding belt, and a self-aligning mechanism for automatically adjusting the position of one belt roller to compensate for variations in the length of a belt over the width of the belt. The belt sander has antifriction bearings supporting each belt roller, a pivotable work table which is supported and guided by guide portions on the belt sander frame over its full travel, and a side gate which opens to allow installation of a sanding belt, and forms a stiffening structural member portion of the belt sander frame when in closed position.

8 Claims, 7 Drawing Figures

VERTICAL BELT SANDING APPARATUS

This invention relates generally to belt-type abrading machines, of the type known as belt sanders.

BACKGROUND OF THE INVENTION

The present invention relates to an improved vertical belt sanding apparatus adapted for use in forming styrofoam and other expanded synthetic-resinous materials in the manufacture of patterns used in the automobile manufacturing industry. The apparatus is provided with an antifriction bearing at each end of the roller over which the sanding belt operates, to enable the use of sanding belts up to 30 inches (76.2 cm) in width, a vacuum system to prevent belt flutter, and a hinged side gate which is provided with bushing which fit pins affixed to the machine so that the side gate serves as a stiffening member.

Applicant is aware of several previous attempts to improve upon belt sanders. U.S. Pat. No. 2,367,107, issued in 1945 to Emmons, entitled "GRINDING", discloses a vertical belt sander wherein the belt is forced to slidably cling to the surface of the platen by spraying coolant on the belt, forming a film between the belt and platen that holds the belt to the platen by surface tension. U.S. Pat. No. 2,857,717, issued in 1958 to Edgemond, Jr. et al, entitled "BELT SANDER" discloses a belt sander which is convertible for horizontal or vertical use, with a spring-loading system to keep the belt tight as it becomes more flexible with use, a worktable that doubles as a fence, and a grooved platen to induce flexing of the belt. U.S. Pat. No. 3,685,219, issued in 1972 to Palmenberg, entitled "CONTOUR ABRASION MEANS AND METHOD", discloses a belt sander for sanding contoured surfaces, wherein the belt is supported from the platen on a film of pressurized air.

Applicant is also aware of the prior practices in the art of machining Styrofoam and the like in the fabrication of patterns for use in the automotive industry. Disk sanders are used, wherein an abrasive disk is adhesively attached to a rotating disk with a horizontal shaft, and a horizontal worktable pivotable about an axis perpendicular to the axis of the sanding disk. This provides a non-fluttering surface, but has various deficiencies in use. In use, the workpiece to be sanded is placed against the abrasive disk in an area where the disk surface is moving downwardly. Should the workpiece be accidentally moved past the center of the disk to the area where the disk surface is moving upwardly, the abrasive digs into the soft Styrofoam workpiece and the workpiece is often pulled from the operator's hand, ruining the workpiece. The present invention overcomes the above-mentioned deficiencies.

SUMMARY OF THE INVENTION

It is an object of the present invention to provide a belt sander having a vacuum distribution system connectible to a conventional exhaust blower system or to an independent vacuum source to maintain a moving abrasive belt in close contact with a flat, perforated platen.

It is a further object of this invention to provide a rigid belt sander having a bearing at each end of each roller over which the belt moves.

It is a further object of this invention to provide a rigid belt sander wherein a hinged side gate with a flat machined surface is provided with bushings which engage hardened pins, and a flat machined surface on the belt sander frame, so that the side gate serves as a stiffening member for the belt sander.

It is a further object of this invention to provide a rigid belt sander having a worktable having support trunnions which engage with trunnion guide portions disposed on the fixed frame of the machine and upon the hinged side gate.

It is a further object of the invention to provide a belt sander which is simple to manufacture and assemble.

DESCRIPTION OF THE PREFERRED EMBODIMENT

Figure 1:
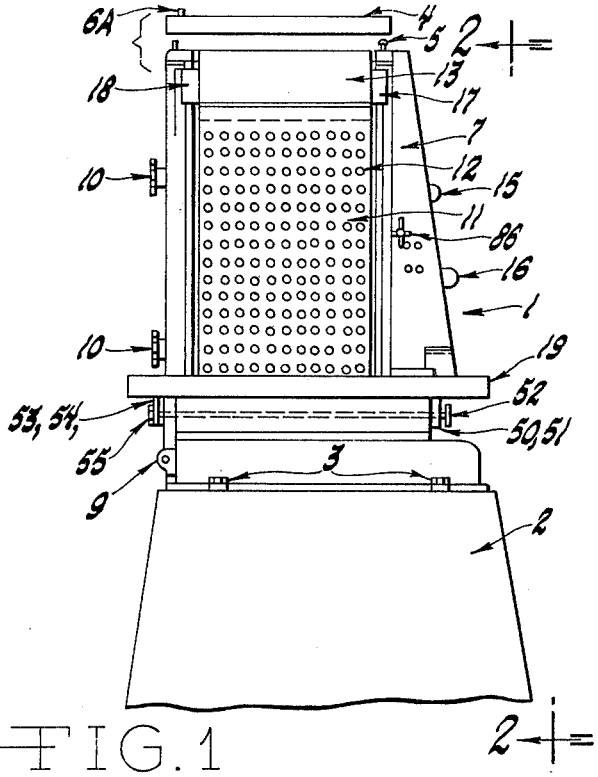
FIG. 1 is a front elevational view of a belt sanding apparatus in accordance with the invention.

FIG. 1 is a front elevation of the preferred embodiment of the invention. Since all figures relate to a single embodiment, the same numbers will be used in all figures whenever possible.

Belt sander 1 is mounted on base 2 by means of bolts 3. Top guard 4, shown separated for clarity, mounts on studs 5 and 6. Stud 5, which is a flat-headed screw or the like, is attached to a first frame member 7. Stud 6, a threaded stud, is attached to a third frame member, side gate 8. Side gate 8 pivots about hinge or cylindrical bar 9, and is retained to frame 7 by knobs 10, which have internal screw threads. The gate 8 is rigidly and substantially immovably connected to frame 7 in at least one position, so that said gate 8 forms a structural element of said frame 7.

The top guard 4 is provided with a slot (not shown) to slip under stud 5, and a round hole (not shown) to slip over stud 6. An internally-threaded knurled nut 6*a* mates with stud 6 to retain top guard 4.

Platen 11, which is one of the novel features of this invention, is provided with a plurality of holes 12 in its front face, holes 12 being 1/16 inch (1.6 mm) in diameter on 1-inch (25.4 mm) centers in the preferred embodiment. In the preferred embodiment, platen 11 has beveled edges for smooth transition of a sanding belt from the platen surface to or from the roller surfaces. In the preferred embodiment, holes 12 are provided to within 1 inch (25.4 mm) of all edges of platen 11. An open-faced chamber, which serves as a vacuum distribution system, is an integral part of frame 7, which is a casting in the preferred embodiment. Also visible in FIG. 1 are vacuum control petcock 86, alignment locking bar 15, tension adjusting bar 16, and bearing housings 17 and 18, which are part of a second frame member upper roller assembly 70, and serve to retain two of the four bearings, which may be either roller or ball bearings, located at the ends of both rollers, so that the invention may be manufactured to use a belt width of up to 30 inches (76.2 cm). Also shown is worktable 19.

Figure 2:
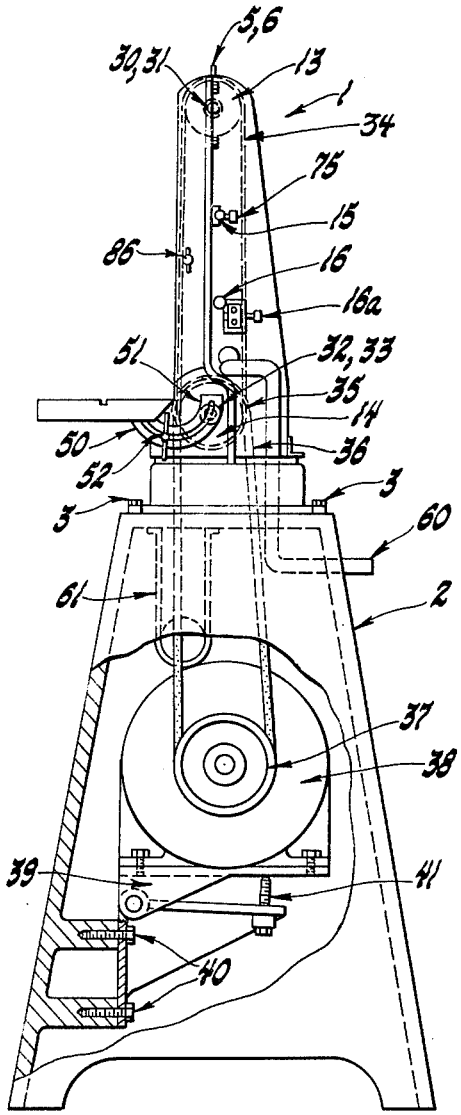
FIG. 2 is a right side elevational view, partially in section, of a belt sander in accordance with FIG. 1.

FIG. 2 is a right side elevation view, partially in section, of the preferred embodiment of the invention. Rollers 13 and 14 are provided with bearings 30, 31, 32 and 33 to support a sanding belt 34 (shown removed for clarity in other figures). Roller 14 is provided with pulley 35, which is driven by belt 36 from pulley 37 on motor 38. Motor 38 is mounted on motor mount 39, which is attached to base 2 by bolts 40, so that the tension of belt 36 may be adjusted by means of bolt 41.

The right side of table 19 is attached to arcuate right trunnion 50, which mates with right trunnion guide 51 on frame 7, and is maintained in the desired position by internally-threaded clamp knob 52, on headed bolt 55. Bolt 55 may be provided with a conventional spring washer (not shown) to maintain a preset friction against trunnion 53.

Tube 60 is connected between platen 11 and a source of vacuum (not shown) which may be either a dust exhaust system blower, or a separate vacuum pump. Housing 61 is connected to a conventional dust exhaust system and, as more precisely shown in FIGS. 5 and 6, extends into frame 7 to near roller 14.

Figure 3:
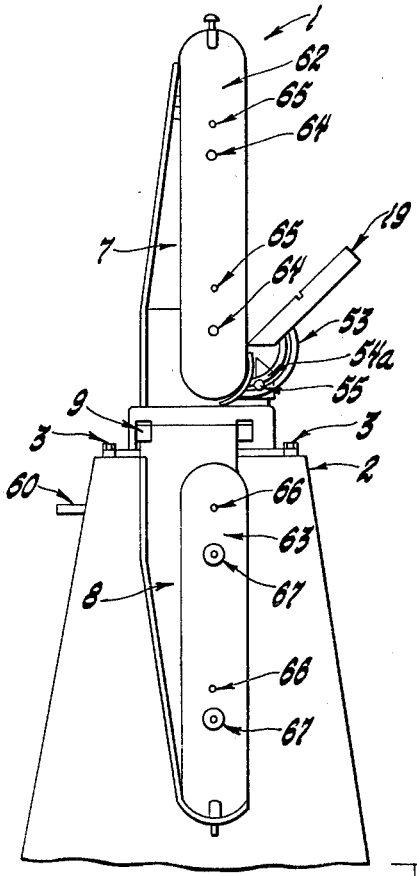
FIG. 3 is a left side elevational view of a belt sander in accordance with the present invention, showing a side gate in accordance with the invention in open position.

FIG. 3 shows a left side elevational view of the preferred embodiment of the invention, with side gate 8 in open position, such as for installing a sanding belt. Surface 62 of frame 7 is a machined surface, as is mating surface 63 of side gate 8. Frame 7 is provided with two hardened steel pins 65, which engage with hardened steel bushings 67 in side gate 8. Frame 7 is also provided with threaded studs 64, which pass through holes 66 in side gate 8, and are adapted to mate with knobs 10. By means of these machined surfaces, and hardened steel pins and bushings, side gate 8 serves as a structural element, enabling the construction of a belt grinder without the need for great strength and rigidity in the stationary part itself. This avoids resulting weight and cost disadvantages, as in prior art devices where movable portions for changing sanding belts function as covers only.

Figure 5:
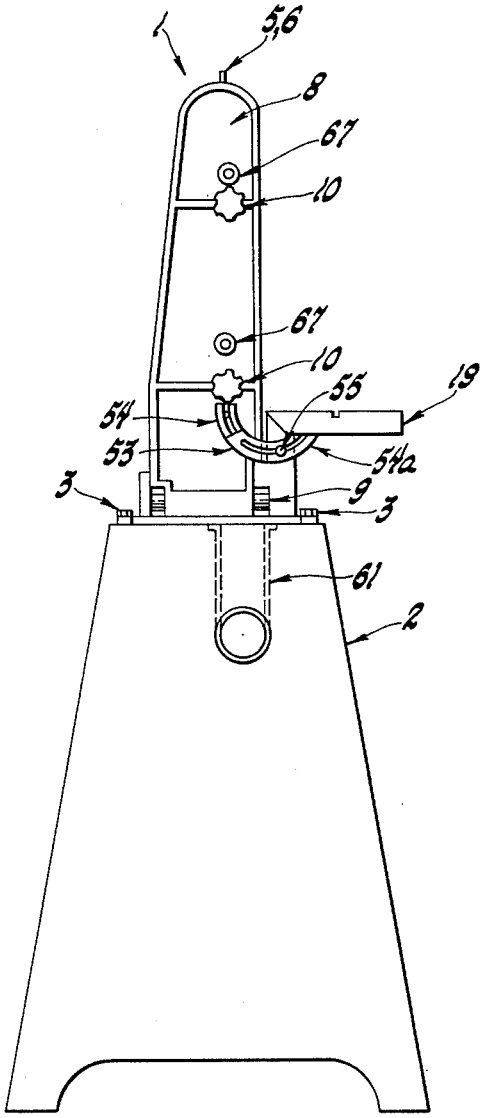
FIG. 5 is a side elevational view of a belt sanding apparatus according to FIG. 4.
Figure 7:
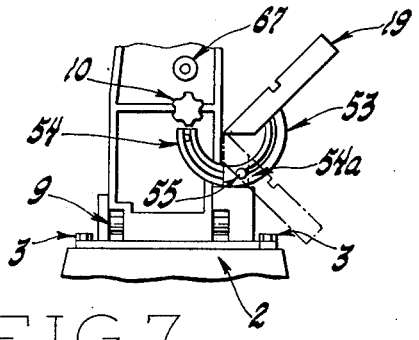
FIG. 7 is a partial side elevational view of a belt sanding apparatus in accordance with the invention, showing a pivotable work table at its uppermost and lowermost positions.

In order to open side gate 8, table 19 must be moved to its maximum upward position (approximately 45°) to disengage left trunnion 53 from the trunnion guide 54 on the outside of side gate 8, shown in FIGS. 5 and 7, but not from trunnion guide **54*a* on frame 7**.

Figure 4:
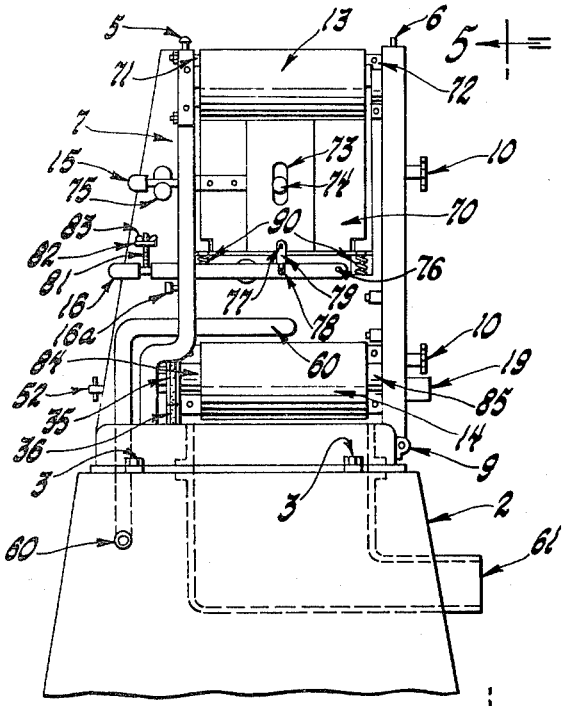
FIG. 4 is a rear elevational view of a belt sanding apparatus according to the invention.

FIG. 4 is a rear view of the preferred embodiment of the invention, showing, among other things, the self-aligning roller mechanism. Bearings 30 and 31 and roller 13 are mounted to upper roll assembly 70 by bearing caps 71 and 72. Upper roll assembly 70 is provided with slot 73, which engages with pivot bolt 74 attached to frame 7. Alignment locking bar 15 is firmly affixed to upper roll assembly 70, and passes beneath clamping knob 75, which has a threaded shaft which fits into a threaded hole (not shown) in frame 7. Tension adjusting bar 16 is pivotably affixed to frame 7 by pivot pin 76, and attached to upper roll assembly 70 by pivot pins 77 and 78 and link 79. Threaded rod 81 is attached to tension adjusting bar 16 in a conventional manner, such as by a bent end passing through a hole (not shown) in arm 16. Rod 81 passes through an open-ended slot in bracket 82, and is provided with wing nut 83. Springs 90 serve to support upper roll assembly 70 against gravity, and provides initial belt tension so that the self-aligning mechanism will operate.

When a new sanding belt is installed, rod 81 is disengaged from bracket 82, allowing bar 16 to be pulled downwardly and retained by hinge latch **16*a*, to lower roller 13 and facilitate belt installation. Then, with the new belt installed, bar 16 is disengaged from latch 16*a*, and rod 81 is re-engaged with bracket 82. If more belt tension than provided by springs 90 is desired, the desired belt tension maybe set by adjusting wing nut 83. Upper roller assembly 70 and roller 13 then pivot about bolt 74 to equalize tension at both edges of the belt. The clamping knob 75 is then tightened, retained arm 15, upper roller assembly 70, and roller 13 in the aligned position, so that the belt will not shift in use as workpieces being sanded are moved across the belt. The above aligning procedure can also be easily performed as a belt becomes more flexible with use. Obviously, the disclosed mechanism can be modified, if desired, by simply adding springs in appropriate locations, such as to set a desired belt working tension, or for urging upper roller assembly 70** to return to a predetermined angular position.

Roller 14 is maintained in a fixed position with respect to frame 7 by bearings 32 and 33, shown in FIG. 2.

FIG. 5 is a left side elevational view of the preferred embodiment of this invention, with side gate 8 closed, and table 19 in horizontal position. As shown, left trunnion 53 engages with trunnion guides 54 and **54*a*, which are disposed on side gate 8, and on frame 7, so that table 19 is firmly supported over its full travel. Portions 54 and 54*a* are precisely aligned due to the pin-and-bushing positioning of side gate 8, and machined surfaces 62 and 63 on frame 7 and side gate 8**, respectively.

Figure 6:
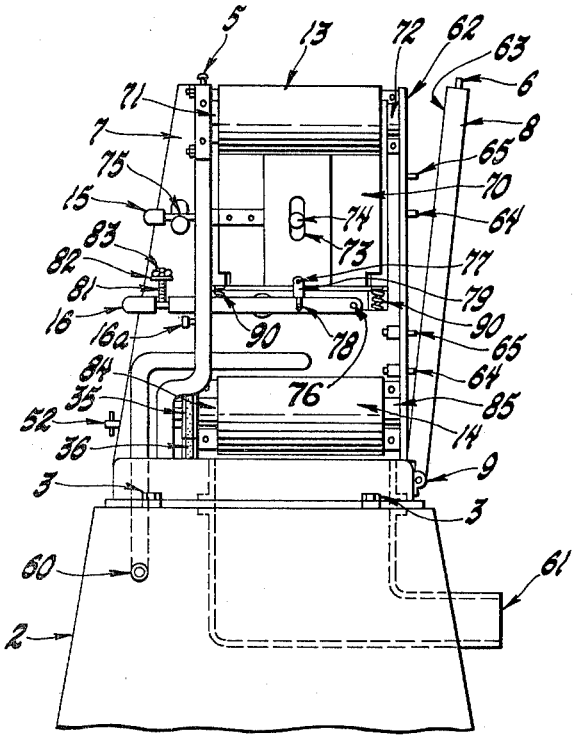
FIG. 6 is a rear elevational view of a belt sanding apparatus in accordance with the invention, showing a side gate according to the invention in partially open position.

FIG. 6, is a rear elevational view of the preferred embodiment of the invention, similar to FIG. 4, showing side gate 8 in a partially open position, so that hardened steel pins 65 and studs 64 are visible. This figure, like FIG. 4, also shows housing 61 extending into base 2, to remove dust from the downwardly-moving portion of the sanding belt as it changes direction on roller 14 to move upwardly at the rear of the machine.

FIG. 7 illustrates table 19 at its uppermost and lowermost positions, approximately 45° from a horizontal in both directions.

While the invention has been described in detail for the preferred embodiment, it will be understood that numerous modifications to the invention may be made by one skilled in the art without departing from the spirit and scope of the invention.

I claim:

1. A vertical belt sanding apparatus comprising:

a plurality of roller means for supporting a sanding belt;

each said roller means being provided with antifriction bearing means at each end thereof;

a first said roller means being supported by a first frame member;

a second said roller means being supported by a second frame member;

means for connecting said first and second frame members for automatically compensating for differences in length across the width of said sanding belt; and vacuum means for firmly holding a moving sanding belt against a platen attached to said first frame member.

2. A vertical belt sanding apparatus according to claim 1, wherein:

said means connecting said first and second frame members includes a pin member attached to said first frame member and an elongated aperture engageable with said pin member in said second frame member.

3. A vertical belt sanding apparatus according to claim 2, wherein:

said means connecting said first and second frame members further includes means for locking said first and second frame means in a predetermined position so that said first and second roller means are maintained in a predetermined angular relationship.

4. A vertical belt sanding apparatus according to claim 1, wherein said vacuum means comprises:

a multiplicity of apertures in a face of said platen;

said apertures in said face being connected to conduit means;

said conduit means being adapted to connect to a source of at least a partial vacuum.

5. A vertical belt sanding apparatus according to claim 1, wherein:

said first frame member includes a third frame member;

said third frame member being pivotally mounted to said first frame member;

said third frame member being rigidly and substantially immovably connected to said first frame member in at least one position, so that said third frame member forms a structural element of said first frame member.

6. A vertical belt sanding apparatus according to claim 1, further including:

means for manually adjusting the distance between said first and second roller means.

7. A vertical belt sanding apparatus according to claim 5, further including:

a table member for supporting a workpiece;

said table member being pivotally connected to said first frame member;

said table member including guide members engageable with mating guide members disposed upon said first frame member and upon said third frame member; and means for maintaining said table member in a predetermined position.

8. A vertical belt apparatus according to claim 1, wherein:

said means for connecting said first and second frame members includes resilient means interposed between said first and second frame members for constantly pressing said first and second frame members apart from each other.

* * * * *